United States Patent [19]

O'Rourke et al.

[11] 4,455,958

[45] Jun. 26, 1984

[54] DRILLSHIP CANOPY

[75] Inventors: J. Cam O'Rourke; Robert E. Marshall, both of Calgary; Frank G. Bercha, Cochrane; G. Roger Pilkington, Calgary, all of Canada

[73] Assignee: Dome Petroleum Limited, Calgary, Canada

[21] Appl. No.: 347,923

[22] Filed: Feb. 11, 1982

Related U.S. Application Data

[63] Continuation-in-part of Ser. No. 111,394, Jan. 11, 1980, abandoned.

[30] Foreign Application Priority Data

Aug. 30, 1979 [CA] Canada ..... 334743

[51] Int. Cl.[3] ..... B63B 35/08

[52] U.S. Cl. ..... 114/40; 114/67 A; 114/361; 180/128; 405/217

[58] Field of Search ..... 114/40, 67 A, 264, 41, 114/42, 361; 180/128; 405/217

[56] References Cited

U.S. PATENT DOCUMENTS 4,323,322 4/1982 O'Rourke et al. ..... 405/217

*Primary Examiner*—Trygve M. Blix

*Assistant Examiner*—Ivy M. Shum

*Attorney, Agent, or Firm*—Lerner, David, Littenberg, Krumholz & Mentlik

[57] ABSTRACT

A canopy system for deployment around the periphery of a vessel floating on a body of water is disclosed primarily for use in connection with drillships in Arctic waters. The disclosed canopy system includes (a) spaced apart structural frames extending outwardly from an inboard end to an outboard free end, the frames being movable between a first position in which a lower edge projects to a point adjacent to the surface of the water in which the vessel is floating, and a second position in which the lower edge projects below the surface of the water; (b) release latches for the two phase releasable securing of the inboard ends of the frames to the periphery of the vessel, including first and second phase release latches to allow frames to move from the first to the second positions, and to allow the frames to be jettisoned from the vessel, respectively; (c) an outer stressed skin supported on the outer surface of the frames; (d) an inner skin supported by the outer stressed skin; (e) a skirt depending from the outboard free end of the frames and projecting below the surface of the water in which the vessel is floating when the frames are in either their first or second positions; and (f) ducts for supplying heated air to the skirt.

11 Claims, 4 Drawing Figures

DRILLSHIP CANOPY

This application is a continuation-in-part of application Ser. No. 111,394 filed Jan. 11, 1980, now abandoned.

BACKGROUND OF THE INVENTION (i) Field of the Invention

This invention relates to improvements in the drilling of oil and gas wells in polar regions. More particularly, it relates to improved techniques for effectuating such drilling in the wintertime in the Arctic Ocean and more especially in the shorefast ice area of the Beaufort Sea, although it is feasible for application in other areas where similar conditions exist. Still more particularly, it relates to a novel canopy for a drillship to provide an ice-free zone around a drillship to enable such wintertime drilling.

(ii) Description of the Prior Art

At the present time, drilling in offshore Arctic regions is carried out in the summertime either by the use of drillships anchored at a drill site where the risk of impingement by ice floes is minimal, or through the use of artificial islands. Summertime drilling is feasible for depths of from 60 feet to 2000 feet or more. Artificial islands currently being used in the shallow waste regions of the Beaufort Sea become excessively expensive in water depths of 40 feet or greater. Moreover, it is presently not feasible to drill exploratory wells from floating ice islands in the regions where ice movement is too great (i.e., greater than a few feet).

One of the chief obstacles to overcome in drilling in Arctic regions is the Arctic pack ice. The ice grows to a thickness of approximately 6 feet and is laced with pressure ridges and ice islands which can reach thicknesses of over 100 feet. The pack ice moves at speeds from 0 to 20 or more miles per day with an average movement of approximately 2 miles per day.

If drilling were to take place in waters where there was considerable ice movement, a very solid structure would be required in order to withstand the forces exerted upon it by the ice pack and yet to be able to remain on position in order to drill a well. For exploratory drilling operations, a solid bottom founded structure should be provided which could resist the movement of the ice pack and yet would be mobile enough to be transported from one exploratory drilling site to another.

Drilling below the ice within sea bottom structures has many problems. Firstly, there is the problem of designing structures which could withstand the ice forces which would be exerted against these structures by deep ice keels. In the second place, subsea systems would have problems of buoyancy, life-support systems, power supply, and access for crews and maintenance.

It would, therefore, be desirable to develop another technique that would allow exploratory drilling during winter months. Such system should also be able to extend operational capability into the shorefast ice. The technique discussed hereinabove has the potential for drilling wells more economically than any other method in the shorefast ice regions. Using this technique, the rate of exploration in the Beaufort Sea would be increased by a factor of from two to four times. This technology of using drillships in shorefast ice could be applied to other regions of the Alaskan Arctic. The techniques used for drilling in shorefast ice are a logical step toward developing year-round drilling systems in pack ice regions.

The development of such technology is important since the risks to the environment of a drilling system in the shorefast ice are relatively low. One advantage of operating in shorefast ice is that the ice moves very little throughout the winter. Any oil spilled underneath the ice would be confined to a very small area where it could be removed from the environment.

The initial problem which the present invention proposes to overcome is the maintenance of a substantially ice-free area around the drillship, and in particular, an ice-free area around a drillship operating in shorefast ice zones during winter. Earlier known methods of maintaining an ice-free zone comprised of conventional icebreaking techniques, namely, the use of icebreaking vessels.

One means for solving the initial problem was provided in copending U.S. application Ser. No. 54,997 filed July 5, 1979 now U.S. Pat. No. 4,323,322 for a Warm Air Canopy System for Providing Ice-Free Zone. That invention provided a method for using a passive structural matrix for strategic deployment of a drillship's waste heat to inhibit ice growth around the drillship. The method employed a system of barge-like modules having forced air heating and peripheral facilities, and a series of intermodular roof sections connecting a set of floating barges around the ship. A method was thus disclosed for providing a substantially ice-free zone around a vessel comprising: (a) creating a finite substantially enclosed zone completely around the periphery of the vessel above the waterline, such zone including a peripheral zone approaching the waterline; (b) continuously circulating warm air within the finite substantially enclosed zone; and (c) continuously injecting warm air into such peripheral zone to prevent ice formation within the peripheral zone. A series of such barges was also provided wherein each barge had a hull shaped to ride up on ice sheets, while the entire perimeter of the system was enclosed with a flexible skirt which permitted ice movement underneath while sealing air within the system. Apparatus was also disclosed for providing a substantially ice-free zone around a vessel comprising, in combination with the vessel: (a) a plurality of floating modules disposed around, and connected at one end, to the vessel; (b) a continuous, downwardly depending skirt extending completely around the outer periphery of the plurality of floating modules; and (c) an air/water heat exchanger in a selected plurality of the floating modules.

Another means for solving such initial problem was provided in copending U.S. application Ser. No. 54,661 filed July 5, 1979 for Barge Construction for Warm Air Canopy Ice-Free Zone. That invention provided a barge comprising: (a) a hull including a bow, a stern, a pair of sides, a flat bottom and a deck; (b) a hull stabilization system including a lattice framework provided with solid insulation material; (c) a liquid/gas heat exchange system within the hull having ducts and outlets from the hull to the surface of the water and air recirculation inflow means; (d) a cantilevered section extending forwardly from the box; and (e) a skirt depending from the forward edge of the cantilevered section.

Yet another means for solving such initial problem was provided in copending U.S. application Ser. No. 54,998 filed July 5, 1979 now U.S. Pat. No. 4,270,476 for Novel Skirt Construction. That invention provided a skirt system comprising: (a) a base; (b) a first flexible external skirt depending from the base, the first skirt being provided with a metallic lip depending below the lower edge; (c) a second flexible internal skirt depending from the base adjacent the first skirt and spaced from, and substantially parallel to, the first skirt, the second skirt being slightly shorter than the first skirt; and (d) a compartment providing an air conduit formed by the space between the parallel first skirt and second skirts.

SUMMARY OF THE INVENTION (i) Aims of the Invention

While these means were adequate for the purposes disclosed, a need still exists for a simple reliable canopy system with contingency features to permit jettison and recovery under emergency conditions.

A main object of the present invention is to provide an apparatus which is simple to construct, which may be easily deployed, and which may be jettisoned under emergency conditions.

Another object of the present invention is to provide a canopy system for a drillship which is used for maintaining an ice-free area around a ship.

A further object of the present invention is to provide such a canopy which uses a forced air heating system to distribute air, either heated by a liquid/gas heat exchange system or by the waste heat from the drillship, in a manner and quantity sufficient substantially to prevent ice formation thereunder.

Yet another object of this invention is to provide such a system with a novel skirt system to assist in providing a substantially ice-free zone around a drillship.

A further object of this invention is to provide such a skirt system which substantially seals the peripheral zone around a drillship while permitting ice movement beneath it.

A still further object of this invention is to provide such a skirt system which can be suspended into water, where there are warm/cold air zones, and where freezing on the cold side will be substantially prevented. In accordance with the present invention, a canopy system for deployment around the periphery of a vessel floating on a body of water has now been provided which accomplishes these and other objects. The canopy system comprises (a) a plurality of spaced apart structural frames extending outwardly from an inboard end to an outboard free end, each of the frames being movable between a first position in which the outer edge thereof projects to a point adjacent to the surface of the body of water in which the vessel is floating, and a second position in which the outer edge projects below the surface of the water in which a vessel is floating; (b) release means for the two phase releasable securing of the inboard end of the frames to the periphery of the vessel, the release means including first and second phase release means being, the first phase release means actuatable to allow the frames to move from the first position to the second position and the second phase release means being actuatable to allow the frames to be jettisoned from the vessel; (c) an outer stressed skin supported by and tensioned over the outer surface of the frames; (d) an inner skin supported by the outer stressed skin; (e) a skirt depending downwardly from the outboard free end of the frames and projecting below the surface of the water in which the vessel is floating when the frames are in either the first or second positions; and (f) a plurality of ducts for supplying heated air to the skirt.

(ii) Other Features of the Invention

By one feature, the inner skin is pressurized to provide an insulating air space.

By another feature, the frames have a generally triangular shape and comprise a back strut, a top member hingedly joined at its inboard end to the upper end of the back strut, and a bottom chord, hingedly joined at its inboard end to the lower end of the back strut, the top member and the bottom chord being joined together at their outboard ends, and including a pair of spaced apart downwardly depending supports at the outboard free end thereof.

By a further feature, the canopy system includes channel members secured to the vessel, the back struts of the frames being releasably disposed within an associated one of the channel members.

By a variation of such feature, the second phase release member comprises a locking bracket secured to the vessel and disposed on one side of the channel member, and a key rod hinged to one end of the channel so as to secure the locking bracket to the latch bar by a key at the other end thereof whereby the latch bar is movable between open and closed positions, the closed position wherein the key rod is engaged and the latch bar is secured to the locking bracket so as to hold the back struts within the channel member and the open position wherein the key is disengaged, and the latch bar is released to thereby allow the back strut to be released from within the channel member, thereby permitting the hinged latch bar to be locked in the closed position to secure the frames to the vessel and to be placed in the open position to permit the frames to be jettisoned from the vessel.

By another feature, the canopy system includes anchor means for securing the inner and outer skins to the top member, the anchor means including clip members.

By still another feature, the canopy system includes a heating system for drawing in fresh air and cooled recycle air, the heating system including a heat exchanger and means for forcing hot air through the heat exchanger and into the ducts.

By another feature, the skirt is formed of rubber coated synthetic fabric, or of 60 oz. natural rubber/nylon fabric and preferably is attached to the outer periphery of the canopy.

By another feature, the first phase release member comprises a brace member movable between first and second position, whereby the brace member when in the first position supports the frame in the first position, and when in the second position allows the frame to slope downwardly into the second position.

Thus, by one main feature of this invention, the canopy consists of a structurally supported membrane cantilevered out from the ship to contain warm air and maintain an open water area around the drillship. The system consists of a set of light structural frames supporting and tensioning a double membrane skin which serves to contain and insulate air heated by a set of electric fan-coil heaters. The seal at the sea side of the canopy is a flexible skirt which permits movement of the ice sheet beneath the canopy. The canopy is a simple and reliable system with contingency features to permit jettison and recovery under emergency conditions.

BRIEF DESCRIPTION OF THE DRAWINGS

In the accompanying drawings.

Figure 1:
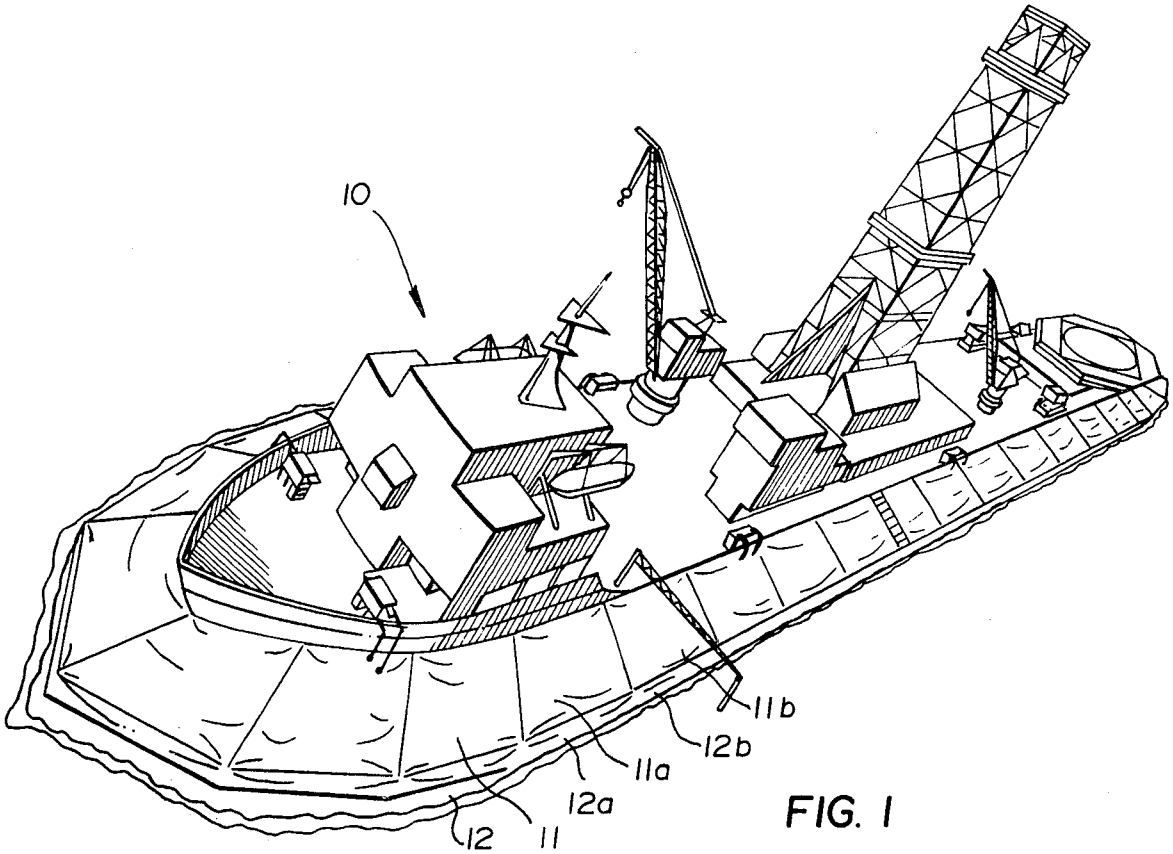
FIG. 1 is a perspective view of one embodiment of a drillship embodying the novel cantilevered canopy and skirt system of this invention.

DESCRIPTION OF PREFERRED EMBODIMENTS (i) Description of FIG. 1

Referring now to FIG. 1, a drillship 10 is shown, the drillship 10 being generally of the type used in offshore drilling operations and particularly in Arctic zones. When operating in this environment, particularly in the wintertime, there is a severe hazard associated with the effect of ice encroaching on the drillship itself.

Means have been proposed as noted hereinbefore for operating a drillship in such Arctic areas in the wintertime, involving the provision of an ice control zone around the drillship. Such ice control zone would be used in conjunction with a substantially ice-free zone close to the drillship. In order to set up and maintain such substantially ice-free zone around the drillship, the canopy shown in FIG. 1 is preferably used. The canopy is provided by a plurality of cantilevered sections 11, 11*a*, 11*b*, etc. whose precise structure and attachment to the drillship 10 will be described with reference to FIGS. 2 and 3. The cantilevered sections 11, 11*a*, 11*b*, etc. are typically 20 feet wide, and terminate in water-engaging skirts 12, 12*a*, 12*b*, etc., which will be described in greater detail hereinafter.

Figure 2:
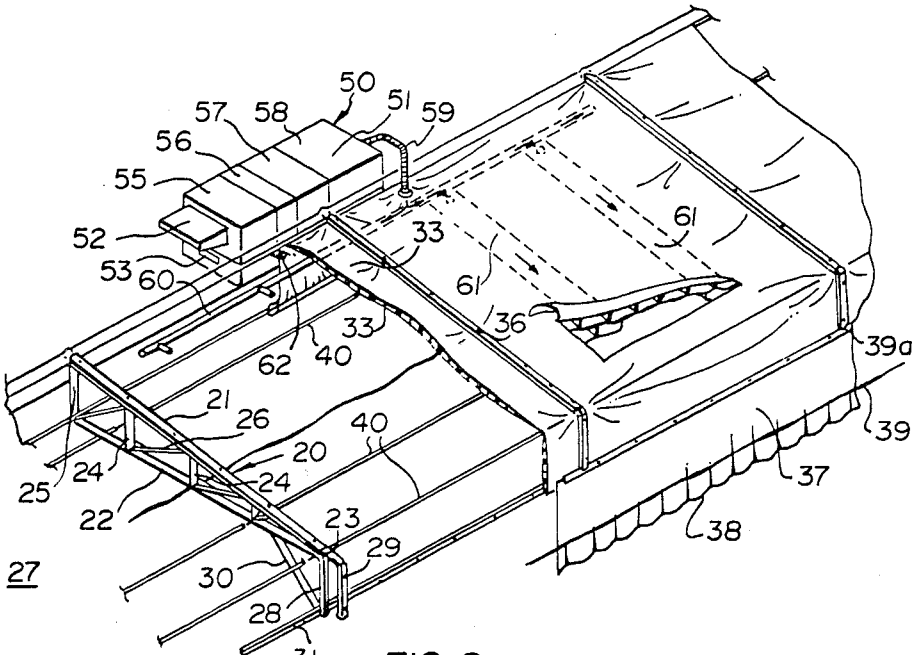
FIG. 2 is a perspective view, partly broken away, of a segment of the cantilevered canopy and skirt system of one embodiment of this invention.

(ii) Description of FIG. 2

As seen in FIG. 2, each cantilevered section 11 is provided by a pair of spaced-apart rigid trusses 20, each truss comprising a top member 21, a bottom chord 22 joined to the outboard end 23 of top member 21, a plurality of upright ribs 24 and a plurality of angled bracings 25. The inboard or back strut 26 is secured to the ship's hull 27 in a manner to be described in greater detail with reference to FIG. 3. The outboard end 23 of the truss is provided with a pair of outboard, spaced-apart, downwardly depending supports 28, 29, the inner one, 28, being braced by bracings 30, and supporting a longitudinally extending skirt anchor 31.

A pair of membrane skins, i.e., inner membrane skin 32 and outer membrane skin 33, are stretched across adjacent truss top members 21 and down along supports 29. They are disposed atop spaced-apart holding rods 34, which are fixed to top member 21 and the membranes are held in place by frictional engagement with U-shaped anchor caps 35 and clips 36 (see FIG. 3). Anchor cap 35 is a U-shaped member whose legs are spaced apart by a distance which is slightly greater than the spacing of the two rods 34 along the top of the truss top member 21. Thus, when the membrane 33 is placed over rods 34, the U-shaped anchor cap 35 can then be placed over the membranes 32, 33 and then engaged to the top member 21 by friction, with the membrane 33 therebetween. Clips 36 are secured to membrane 33 which projects through a slot (unnumbered) in the upper surface of anchor cap 35. A flexible skirt membrane 37, whose lower edge 38 is adapted to be disposed below the water level 39, is also provided. A plurality of spaced-apart longitudinally extending adjustable rods 40 provide additional rigidity for the cantilevered structure.

A forced air heating system 50 is provided for the canopy system. It includes a main housing 51 which is provided with a fresh air intake 52 and an exhaust air outlet 53. A mixing box 56 for fresh air and recycle cool air is provided leading by way of air filters 55 to a heater, which may desirably be an electric coil heater 57. A fan 58 impels the hot air through a flexible duct 59 to a distributing hot air duct 60. Distributing duct 60 leads the hot air to spaced-apart transversely extending duct membranes 61 between the inner skin 32 and the outer skin 33. Return cool air is collected by cool air return duct 62 to be returned to the mixing box 50.

As shown in one embodiment in FIG. 2, the main structural members are a series of 60 aluminum trusses, weighing approximately 680 lbs. each, cantilever-mounted to the ship's hull. All connections are bolted to facilitate field assembly and disassembly for storage and transportation purposes. The membrane roof consists of a multiple membrane assembly, with the outer membrane, a tough Arctic 18 oz. fabric, serving as the stressed skin. A lighter interior 10 oz. membrane forms a double, lightly pressurized, insulating air space, and heavier interior membranes serve as forced air ducts, distributing the heat to the extremities of the canopy. Maintenance of the double air space is achieved by a top-up pneumatic system operating through a 0.1 p.s.i. control valve and tubed to the perimeter of the canopy. The air space also provides sufficient displacement to float the canopy in case jettisoning is required.

The heating system, in one embodiment, is forced air, electric heating, powered by existing shipboard generators.

Physically, the system consists of a set of eight fan-coil heaters located about the perimeter of the ship, and ducted to and from the canopy by means of flexible ducts. Supply ducts connect to a header duct under the canopy servicing eight modules. In each module two distribution outlets connect to the two membrane ducts. A special nozzle is located near the perimeter to direct high velocity warm air to the skirt for adfreeze prevention at the ice edge.

Figure 3:
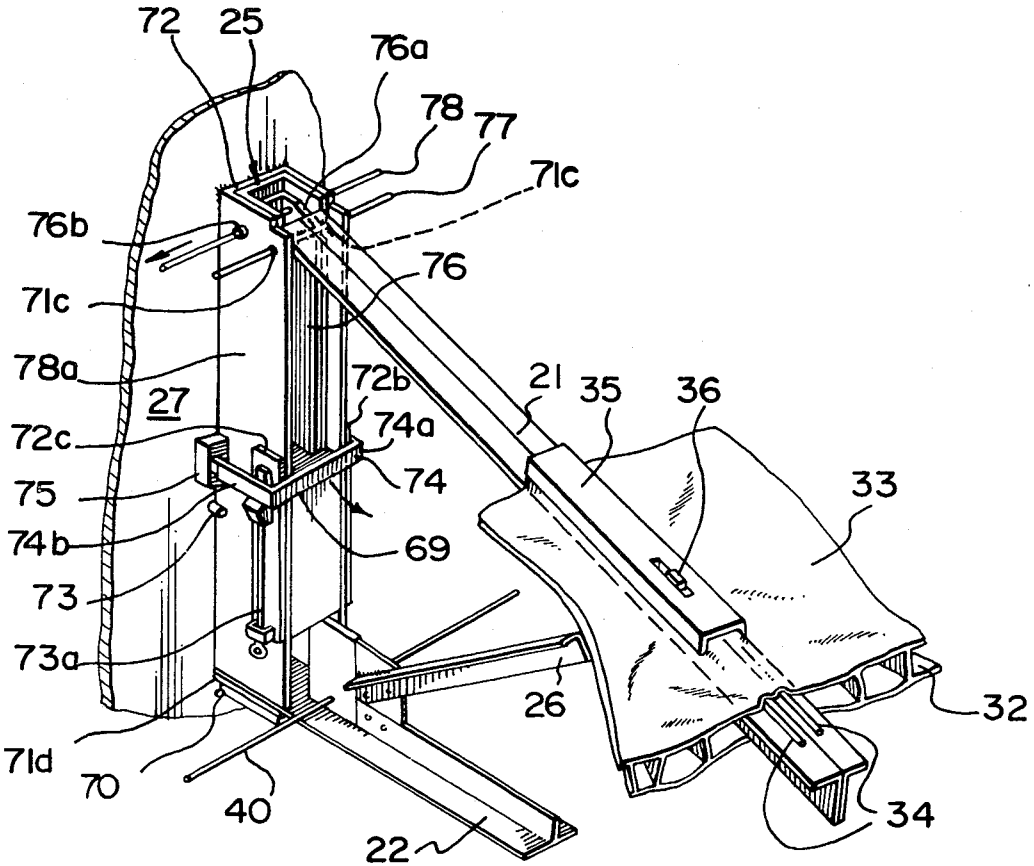
FIG. 3 is a perspective view of a releasable connection of this invention for securement of the canopy to the drillship.

(iii) Description of FIG. 3

The means of securing the cantilevered canopy to the drillship is shown in detail in FIG. 3. Each top member 21 of rigid truss 20 is hingedly connected to its associated back strut 25, which is in the cross-sectional shape of a U-shaped member having side walls 71*a* and back wall 71*b* by means of longitudinally extending hinge rod 77 passing through aligned spaced-apart apertured depending ears 71*c*. The slope of top member 21 is controlled by a removable channel member 76 having a supporting angled surface 76*a*. Removable channel member 76 is held in place by upper shipside lock 76*b* controlled by longitudinally slidable operator rod 78, which is slidable with respect to upright guiding brace 78*a*. Bottom chord 22 of rigid truss 20 is hingedly connected to back strut 25 at bottom ears 71*d* by hinge rod 70.

Back strut 25 is held temporarily but securely to the ship's hull 27 by means of a clamping mechanism 69. Mechanism 69 includes a U-shaped restraining bracket 72 secured with its back wall 72*a* to the ship's hull 27 and with U-shaped back strut 25 slidable therebetween. A face place 74 is hingedly connected at one end (74*a*) to one side face (72*b*) of back restraining bracket 72 and latchably secured (at 74*b*) to the other side face (72*c*) of back restraining bracket 72 by restraining latch 75 and vertically movable latch pin 73 controlled by vertically slidable operator rod 73*a*. Plate 74 retains the front faces of back strut 25 within the restraining bracket 72.

The securing system is also a jettisoning system. Longitudinal sliding of longitudinally slidable operator rod 78 causes upper latch 76*b* to be withdrawn, thus allowing for the jettisoning of the removable channel member 76. Since the bottom face of top member 21 is no longer supported by the angled surface 76*a*, the top member 21 droops to more acute angle and the bottom member 22 droops to an obtuse angle, all with respect to a back strut 25. This allows the flexible skirt member 37 to bob and dip deeper below the surface 39 of the water.

Operation of the latch 73 by vertical sliding of vertically slidable rod operator rod 73*a* results in releasing face plate 74, allowing face plate 74 to swing outwardly as shown by the arrow. This permits the entire strut system 20, consisting of back strut 25, top member 21, tower member 22, connecting struts 24 and angled braces 26, along with the entire canopy 11 to be jettisoned from within restraining bracket 72.

Thus, FIG. 3 shows the concept of a two-phase jettisoning system. The canopy trusses are mounted in a series of channel-like vertical members, seated on a bottom plate, and held by means of a latch mechanism. The channel seats in turn are hinged at the bottom to permit the canopy to tip down. Activation of a lock at shipside releases the upper end of the channel seats. Consequently, in case of extreme wind conditions, the shipside lock in the channels would be released to provide a first phase of the jettisoning system, i.e., to allow the outer edge of the canopy to tip into the water. If conditions deteriorated further and vessel safety was threatened, the entire canopy could be jettisoned by activation of the release rod which opens the restraining latch, making the entire canopy free of the ship. Heat ducts are designed automatically to disconnect under the force of the moving canopy. Design conditions for the structural system include a 70 knot wind, 20 psf snow load, lower temperature service, and general requirements of stiffness and durability for Arctic operation deployment.

Figure 4:
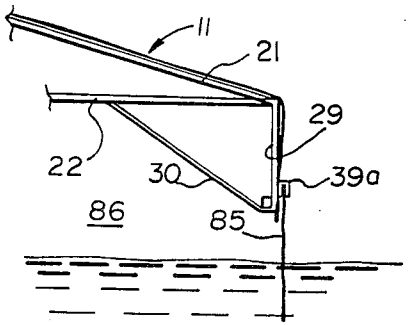
FIG. 4 is a section of a typical skirt configuration of this invention.

Description of FIG. 4

As seen in FIG. 4, skirt 85 depends from the outboard end of cantilever section 11 to slightly below the water surface 39, thereby forming an air compartment 86 below the cantilever section 11.

Alternatively, the skirt may be as described in the above-identified copending U.S. application Ser. No. 54,998, the contents of which are hereby incorporated by reference.

The skirt 85 is preferably made of a rubber coated synthetic fiber fabric, e.g., a 60 oz. natural rubber/nylon fabric. Means, e.g., fan 58, are provided for circulating air in compartment 86.

Generalized Description of the Preferred Embodiment

The structural frames and spreaders are designed so that they can preferably be prefabricated at a suitable aluminum extrusion plant. Hold downs, latches, seats, key rods, and all other steel components will be similarly prefabricated. The membrane, including duct installation, can be prefabricated in modules of 20×40 feet at one of several plants possessing fabric thermal seam welding facilities.

The main mechanical system components, the fan-coil and mixer units, are essentially standard items, and only nominal makeup time is foreseen for selection and prefabrication of suitable ducting and control systems. The pneumatic top-up system will be field fabricated with the exception of the control valves which will be pre-ordered.

Pre-deployment activities at the drillship include welding of frame seats to the hull, electrical distribution system preparation, pneumatic system preinstallation, and heater support provision. After these one-time activities are completed, the canopy itself can be deployed within several days. Total weight of the package is 50 tons and the minimal bulk of the system permits it to be readily carried on a supply vessel deck or barge.

In one embodiment, the preassembled frames weigh approximately 680 lbs. each, and will be handled by cranes in the midship sections, and by a special davit in the bow and stern regions. The assembled membrane systems weigh 200 lbs. for a 20×40 ft. panel. Installation of these membrane panels will be fabricated by following established procedures for existing fabric structure systems.

Engineering and economic feasibility of over twenty different combinations of structural and mechanical systems, including structurally supported membranes, insulating blankets, air supported and inflated structures, tensioned membranes, foam core barges, articulating rigid insulation systems involving both floating and cantilever mechanisms were conducted. Mechanical systems included hot water injection, bubblers, forced air and convection tubes. Utilization of power sources, e.g., waste heat, generators, and environmental heat reserve, were also evaluated. The cantilever structurally supported membrane system with an electrically heated forced air system has been selected through the concept optimization procedure. A small prototype test, involving a 50×30 ft. canopy and forced air heating system, was carried out in the Beaufort Sea in the water of 1977 to 1978. Calculations and heating system design were found to agree with performance observations.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly equitably, and "intended" to be, within the full range of equivalence of the following claims.

We claim:

1. A canopy system for deployment around the periphery of a vessel floating on a body of water, comprising:

(a) a plurality of spaced-apart, structural frames extending outwardly from an inboard end to an outboard free end, each of said frames being movable between a first position in which the outer edge thereof projects to a point adjacent to the surface of said body of water on which said vessel is floating, and a second position in which said outer edge projects below said surface of the water on which said vessel is floating;

(b) release means for a two-phase releasable securing of the inboard end of said frames to the periphery of said vessel, said release means including first and second phase release members, said first phase release member being actuatable to allow said frames to move from said first position to said second position, and said second phase release member being actuatable to allow said frames to be jettisoned from said vessel;

(c) an outer stressed skin supported by, and tensioned over, the outer surface of said frames;

(d) an inner skin supported by said outer stressed skin;

(e) a skirt depending downwardly from the outboard free end of said frames, and projecting below said surface of said water on which said vessel is floating when said frames are in either their first or second positions; and (f) a plurality of ducts for supplying heated air to the said skirt.

2. The canopy system of claim 1 wherein said inner skirt is pressurized to provide an insulating air space.

3. The canopy system of claim 1 wherein said frames have a generally triangular shape and comprise a back strut, a top member hingedly joined at its inboard end to the upper end of said back strut, and a bottom chord, hingedly joined at its inboard end to the lower end of said back strut, said top member and said bottom chord being joined together at their outboard ends, and including a pair of spaced apart downwardly depending supports at the outboard free end thereof.

4. The canopy system of claim 3 including channel members secured to said vessel, said back struts of said frames being releasably disposed within an associated one of said channel members.

5. The canopy system of claim 4 wherein said second phase release member comprises a locking bracket secured to said vessel and disposed on one side of said channel member, a U-shaped latch bar hinged at one end to said vessel and having another end disposed on the other side of said channel member, and a key rod hinged to one end of said channel so as to secure said locking bracket to said latch bar by a key at said other end thereof whereby said latch bar is movable between open and closed positions, said closed position wherein said key rod is engaged and said latch bar is secured to said locking bracket so as to hold said back struts within said channel member, and said open position wherein said key is disengaged, and said latch bar is released to thereby allow said back strut to be released from within said channel member, thereby permitting said hinged latch bar to be locked in said closed position to secure said frames to said vessel and to be placed in said open position to permit said frames to be jettisoned from said vessel.

6. The canopy system of claim 3 including anchor means for securing said inner and outer skins to said top member, said anchor means including clip members.

7. The canopy system of claim 1 including a heating system for drawing in fresh air and cooled recycle air, said heating system including a heat exchanger and means for forcing hot air through said heat exchanger and into said ducts.

8. The canopy system of claim 1 wherein said skirt is formed of rubber coated synthetic fabric.

9. The canopy system of claim 1 wherein said skirt, formed of rubber coated synthetic fabric, is attached to the outer periphery of the canopy.

10. The canopy system of claim 1 wherein said skirt is formed of 60 oz. natural rubber/nylon fabric.

11. The canopy system of claim 1 wherein said first phase release member comprises a brace member movable between first and second positions, whereby said brace member when in said first position supports said frame in said first position, and when in said second position allows said frame to slope downwardly into said second position.

* * * * *